US008230793B2

(12) United States Patent
Apps

(10) Patent No.: US 8,230,793 B2
(45) Date of Patent: Jul. 31, 2012

(54) NESTABLE PALLET

(75) Inventor: William P. Apps, Alpharetta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 190 days.

(21) Appl. No.: 12/753,188

(22) Filed: Apr. 2, 2010

(65) Prior Publication Data

US 2010/0236455 A1 Sep. 23, 2010

Related U.S. Application Data

(63) Continuation of application No. 11/763,988, filed on Jun. 15, 2007, now Pat. No. 7,690,315.

(51) Int. Cl.
*B65D 19/38* (2006.01)

(52) U.S. Cl. ..... 108/53.3; 108/57.28; 108/901

(58) Field of Classification Search ..... 108/53.1, 108/53.3, 901, 57.25, 57.28
See application file for complete search history.

(56) References Cited

U.S. PATENT DOCUMENTS

| | | | |
|---|---|---|---|
| 1,910,781 | A | 5/1933 | Way |
| 2,544,657 | A | 3/1951 | Cushman |
| 2,699,912 | A | 1/1955 | Cushman |
| 2,828,933 | A | 4/1958 | De Pew et al. |
| 2,991,965 | A | 7/1961 | Drieborg |
| 3,126,843 | A | 3/1964 | De Laney |
| 3,152,693 | A | 10/1964 | Anderson |
| 3,187,689 | A | 6/1965 | Hess |
| 3,307,504 | A | 3/1967 | Cloyd et al. |
| 3,424,110 | A | 1/1969 | Toot |
| 3,467,032 | A | 9/1969 | Rowlands et al. |
| 3,481,285 | A | 12/1969 | Yellin |
| 3,526,195 | A | 9/1970 | Maryonovich |
| 3,580,190 | A | 5/1971 | Fowler |
| 3,602,157 | A | 8/1971 | Cohen et al. |
| 3,603,272 | A | 9/1971 | Ditges |
| 3,606,844 | A | 9/1971 | Lubker et al. |
| 3,613,605 | A | 10/1971 | Holdredge, Jr. |
| 3,638,586 | A | 2/1972 | Elshout |
| 3,640,229 | A | 2/1972 | Bell |
| 3,651,769 | A | 3/1972 | Foley |
| 3,654,874 | A | 4/1972 | Skinner |
| 3,664,271 | A | 5/1972 | Wolder et al. |
| 3,667,403 | A | 6/1972 | Angelbeck, Jr. |
| 3,675,595 | A | 7/1972 | Sullivan |
| 3,678,868 | A | 7/1972 | Hirota |
| 3,680,495 | A | 8/1972 | Pike |
| 3,680,496 | A | 8/1972 | Westlake, Jr. |

(Continued)

FOREIGN PATENT DOCUMENTS

| | | |
|---|---|---|
| DE | 2613083 | 10/1977 |

(Continued)

OTHER PUBLICATIONS

United Kingdom Search Report for UK Application No. 0810730.2, Sep. 2, 2008.

*Primary Examiner* — Hanh V Tran
(74) *Attorney, Agent, or Firm* — Carlson, Gaskey & Olds

(57) ABSTRACT

A nestable pallet includes an upper deck from which a plurality of feet extend downwardly. The upper deck includes an upper planar member and cross-ribs extending downwardly therefrom. The pallet is sturdy yet light weight and can be optionally provided with a reinforcement sheet secured to the lower ends of the ribs to provide a stronger, stiffer pallet.

21 Claims, 8 Drawing Sheets

U.S. PATENT DOCUMENTS 3,683,821 A 8/1972 Mangold
3,685,461 A 8/1972 Belcher
3,685,463 A 8/1972 Francis
3,699,901 A 10/1972 Cook, III
3,699,902 A 10/1972 Allgeyer et al.
3,709,162 A 1/1973 Roper
3,710,733 A 1/1973 Story
3,720,176 A 3/1973 Munroe
3,759,194 A 9/1973 Fujii et al.
3,795,206 A 3/1974 Utz
D231,096 S 4/1974 Adam
3,814,031 A 6/1974 Fowler
D232,019 S 7/1974 Rehrig et al.
3,824,933 A 7/1974 Lind
3,835,792 A 9/1974 Wharton
3,861,326 A 1/1975 Brown
3,868,915 A 3/1975 Hafner
3,878,796 A 4/1975 Morrison
3,916,803 A 11/1975 Garcia
3,917,066 A 11/1975 Cloyd
3,938,448 A 2/1976 Nishitani et al.
3,964,400 A 6/1976 Brand
3,994,241 A 11/1976 Evans
4,002,126 A 1/1977 Bell et al.
4,013,021 A 3/1977 Steinlein et al.
4,051,787 A 10/1977 Nishitani et al.
D246,296 S 11/1977 Fujii et al.
4,103,857 A 8/1978 Levenhagen
4,133,270 A 1/1979 Ravera
4,146,205 A 3/1979 Skinner
4,183,491 A 1/1980 Sanders et al.
4,220,100 A 9/1980 Palomo et al.
4,287,836 A 9/1981 Aoki
4,316,419 A 2/1982 Cupido
4,403,555 A 9/1983 Forrest
4,428,306 A 1/1984 Dresen et al.
4,597,338 A 7/1986 Kreeger
4,606,278 A 8/1986 Shuert
RE32,344 E 2/1987 Wind
4,735,154 A 4/1988 Hemery
4,742,781 A 5/1988 Shuert
4,799,433 A 1/1989 Luft
4,843,976 A 7/1989 Pigott et al.
4,869,456 A 9/1989 Jacobs
4,879,956 A 11/1989 Shuert
4,951,852 A 8/1990 Kempkes
4,972,782 A 11/1990 Shepherd
4,998,619 A 3/1991 Sowa et al.
5,042,396 A 8/1991 Shuert
5,046,434 A 9/1991 Breezer et al.
5,097,951 A 3/1992 Pigott et al.
5,117,762 A 6/1992 Shuert
5,154,286 A 10/1992 Gits
5,160,029 A 11/1992 Pigott et al.
5,197,395 A 3/1993 Pigott et al.
5,205,221 A 4/1993 Melin et al.
D346,681 S 5/1994 Pigott et al.
D347,511 S 5/1994 Pigott et al.
5,337,681 A 8/1994 Schrage
5,343,814 A 9/1994 Pigott et al.
D354,606 S 1/1995 Pigott et al.
5,391,251 A 2/1995 Shuert
5,401,347 A 3/1995 Shuert
5,404,829 A 4/1995 Shuert
5,407,632 A 4/1995 Constantino et al.
5,413,052 A 5/1995 Breezer et al.
D364,030 S 11/1995 Pigott et al.
5,470,641 A 11/1995 Shuert
5,520,121 A 5/1996 Schubart et al.
D370,763 S 6/1996 Pigott et al.
5,527,585 A 6/1996 Needham et al.
D371,882 S 7/1996 Kristoffersson
D372,192 S 7/1996 Pigott et al.
5,549,056 A 8/1996 Jordan et al.
5,555,820 A 9/1996 Shuert
5,566,624 A 10/1996 Brown et al.
5,579,686 A 12/1996 Pigott et al.
D378,458 S 3/1997 Pigott et al.
5,638,760 A 6/1997 Jordan et al.
5,666,886 A 9/1997 Alexander et al.
5,676,064 A 10/1997 Shuert
D388,931 S 1/1998 Constantino et al.
5,736,221 A 4/1998 Hardigg et al.
5,755,162 A 5/1998 Knight et al.
5,769,001 A 6/1998 Viessmann
5,778,801 A 7/1998 Delacour
D398,731 S 9/1998 Pigott et al.
D398,732 S 9/1998 Pigott et al.
5,806,436 A 9/1998 Weichenrieder et al.
5,813,355 A 9/1998 Brown et al.
D400,682 S 11/1998 Constantino et al.
5,836,255 A 11/1998 Uitz
5,845,588 A 12/1998 Gronnevik
5,868,080 A 2/1999 Wyler et al.
5,894,803 A 4/1999 Kuga
5,950,546 A 9/1999 Brown et al.
5,967,057 A 10/1999 Nakayama et al.
5,996,508 A 12/1999 Constantino et al.
6,125,770 A 10/2000 Brandenburg
6,199,488 B1 3/2001 Favaron et al.
6,250,234 B1 6/2001 Apps
6,283,044 B1 9/2001 Apps
6,289,823 B1 9/2001 Koefelda et al.
6,294,114 B1 9/2001 Muirhead
6,327,984 B1 12/2001 McCann et al.
6,354,230 B1 3/2002 Maschio
6,357,366 B1 3/2002 Frankenberg
6,389,990 B1 5/2002 Apps
6,446,563 B1 9/2002 Ohanesian
6,622,641 B2 9/2003 Smyers
6,626,634 B2 9/2003 Hwang et al.
6,698,362 B2 3/2004 Crevillen Pastor
6,718,888 B2 4/2004 Muirhead
7,197,989 B2 4/2007 Apps
2001/0029874 A1 10/2001 Muirhead
2004/0134390 A1 7/2004 Apps et al.
2004/0168618 A1 9/2004 Muirhead
2005/0211139 A1 9/2005 Perrotta et al.
2006/0032413 A1 2/2006 Ogburn et al.

FOREIGN PATENT DOCUMENTS

DE 2733457 2/1979
DE 3205910 11/1983
DE 3806097 9/1989
DE 19651999 6/1998
DE 2232200 6/2007
EP 0202203 11/1986
EP 0226505 11/1986
EP 0301445 2/1989
EP 0404019 12/1990
EP 0754540 1/1997
EP 0849184 6/1998
FR 1449377 8/1966
FR 2206248 6/1974
FR 2274512 8/1974
FR 2259023 1/1975
FR 2486029 7/1980
FR 2715127 7/1995
GB 859186 1/1961
GB 901340 7/1962
HU 9303243 3/1994
HU 9900326 5/1999
JP 53 058581 5/1978
JP 4-114859 A 4/1992
JP 06-179448 6/1994
JP 09 202327 8/1997
WO 90/01448 2/1990
WO 94/08861 4/1994
WO 94/10051 5/1994
WO 94/11262 5/1994
WO 97/09239 3/1997
WO 03/051726 6/2003
WO 2004/063035 7/2004
WO 2005/211139 7/2005

NESTABLE PALLET

CROSS-REFERENCE TO RELATED APPLICATION

This is a continuation of U.S. Ser. No. 11/763,988, filed on Jun. 15, 2007 now U.S Pat. No. 7,690,315.

BACKGROUND

This invention relates to a nestable pallet for storing or transporting goods. Pallets are often used to store and transport goods. The pallets maintain the goods at a distance above the floor such that they can be readily lifted and moved by a fork of a lift truck. Some pallets have stringers or double decks forming openings which receive the forks of the lift truck. Other pallets are nestable within one another to facilitate storage and transport when empty. Generally, nestable pallets typically have openings in their upper surface, which receive corresponding shaped feet of a similar nestable pallet. Thus, the nestable pallets occupy less space for storage and transport when empty.

Depending on the type of goods that are being transported, sometimes a pallet with greater strength and stiffness is required. Other times, for storing and shipping lighter goods, a lighter weight pallet would be desirable. Currently pallets of different weights and strengths are made in different molds, which increases cost.

SUMMARY

The present invention provides a nestable pallet with an optional welded bottom. The pallet includes an upper deck and feet extending downward therefrom. The upper deck includes an upper planar member. A plurality of cross-ribs are formed on the under side of the planar member to reinforce the upper surface of the upper deck. The feet are generally hollow and open upwardly, such that they can receive nested therein corresponding feet of a similar container stacked thereon when empty. This provides a light weight pallet.

An optional welded bottom can be secured to the ribs of the upper deck. The welded bottom may be a lower planar member, such as an injection molded flat sheet. The planar member includes openings through which the feet are inserted. The planar member is then secured to the outer ends of the ribs, such as by vibration welding or hot plate welding. Alternatively, adhesives or other types of bonding could be utilized.

Thus, a single pallet can be provided in two different variations, with or without the welded bottom. The pallet can be provided in the light weight version without the welded bottom, or the stronger, stiffer pallet with the welded bottom.

These and other features of the application can be best understood from the following specification and drawings, the following of which is a brief description.

DETAILED DESCRIPTION OF THE PREFERRED EMBODIMENT

Figure 1:
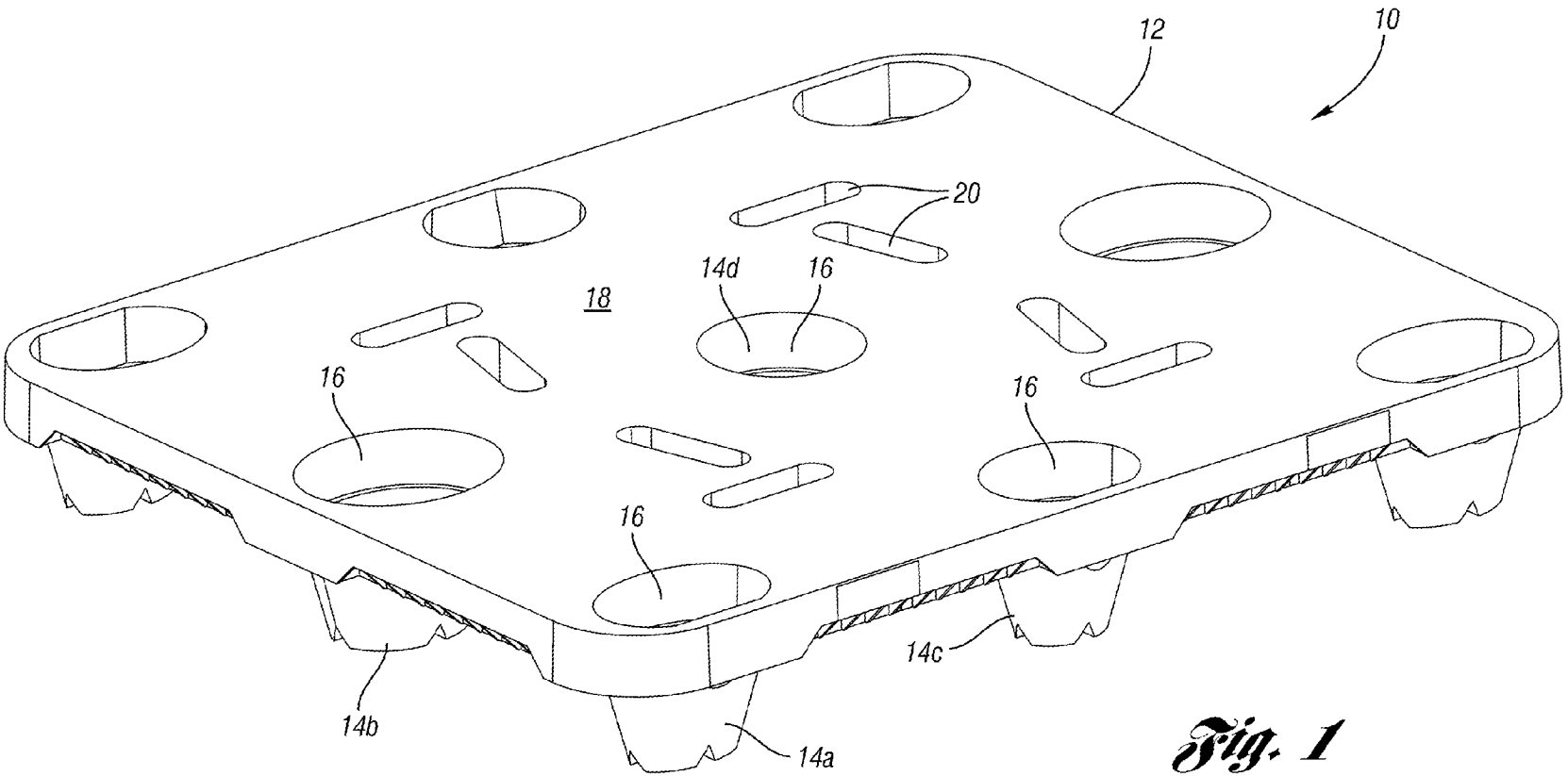
FIG. 1 is a perspective view of a pallet according to one embodiment of the present invention.

A pallet 10 according to one embodiment of the present invention is shown in FIG. 1. The pallet 10 includes an upper deck 12 down from which extend a plurality of feet 14*a-d*, including corner feet 14*a*, end feet 14*b*, side feet 14*c* and a center foot 14*d* (unless otherwise more specifically referenced, the referenced numeral "14" used below will refer to all of the feet 14*a-d*).

Each of the feet 14 has defined therein a recess opening upwardly for receiving a corresponding foot of a similar container nested therein. The upper deck 12 includes an upper planar member 18 through which the openings 16 and the feet 14 are also defined. Handle openings 20 also extend through the upper planar member 18 of the upper deck 12.

Figure 2:
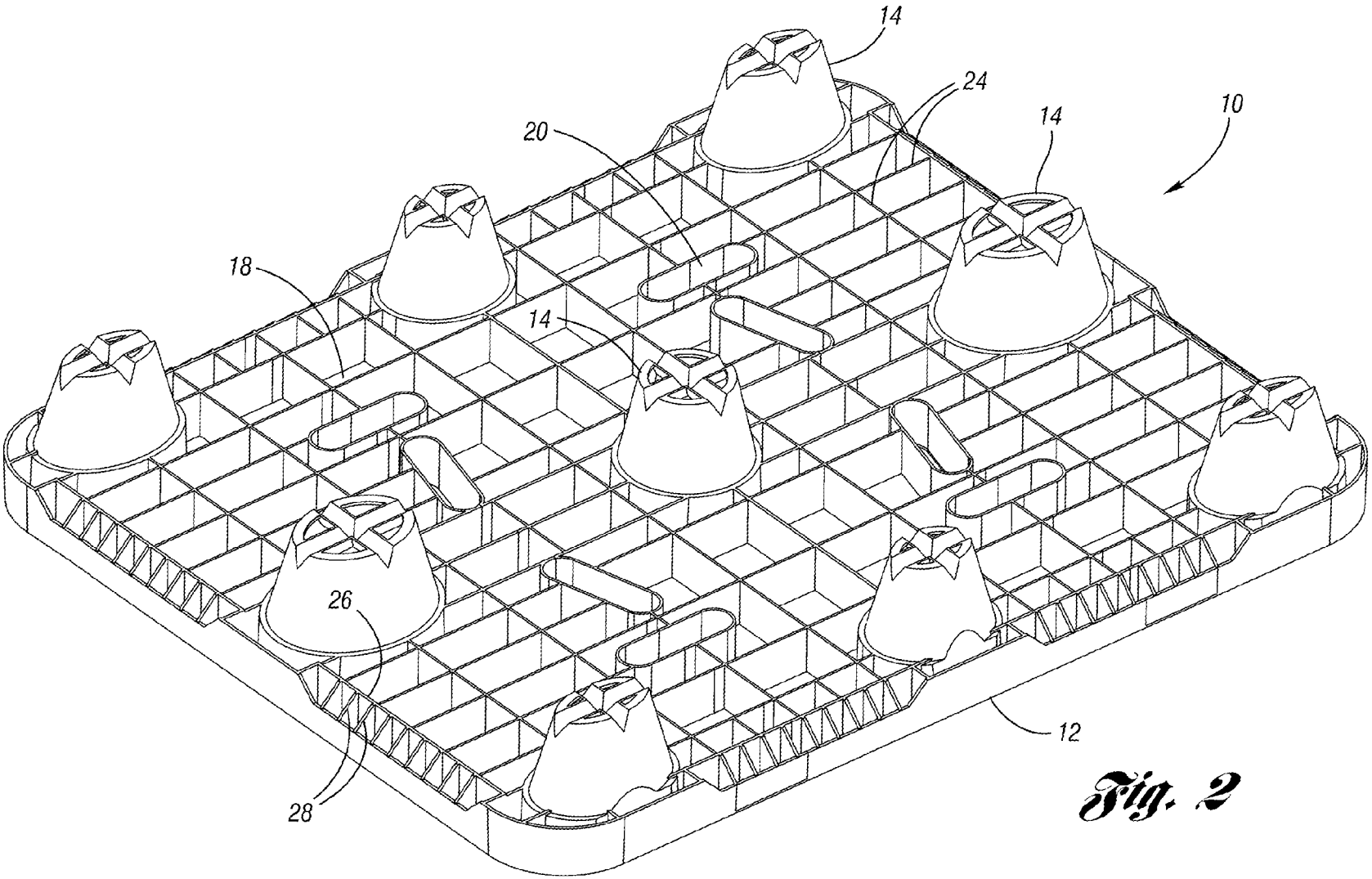
FIG. 2 is a bottom perspective view of the pallet of FIG. 1.
Figure 3:
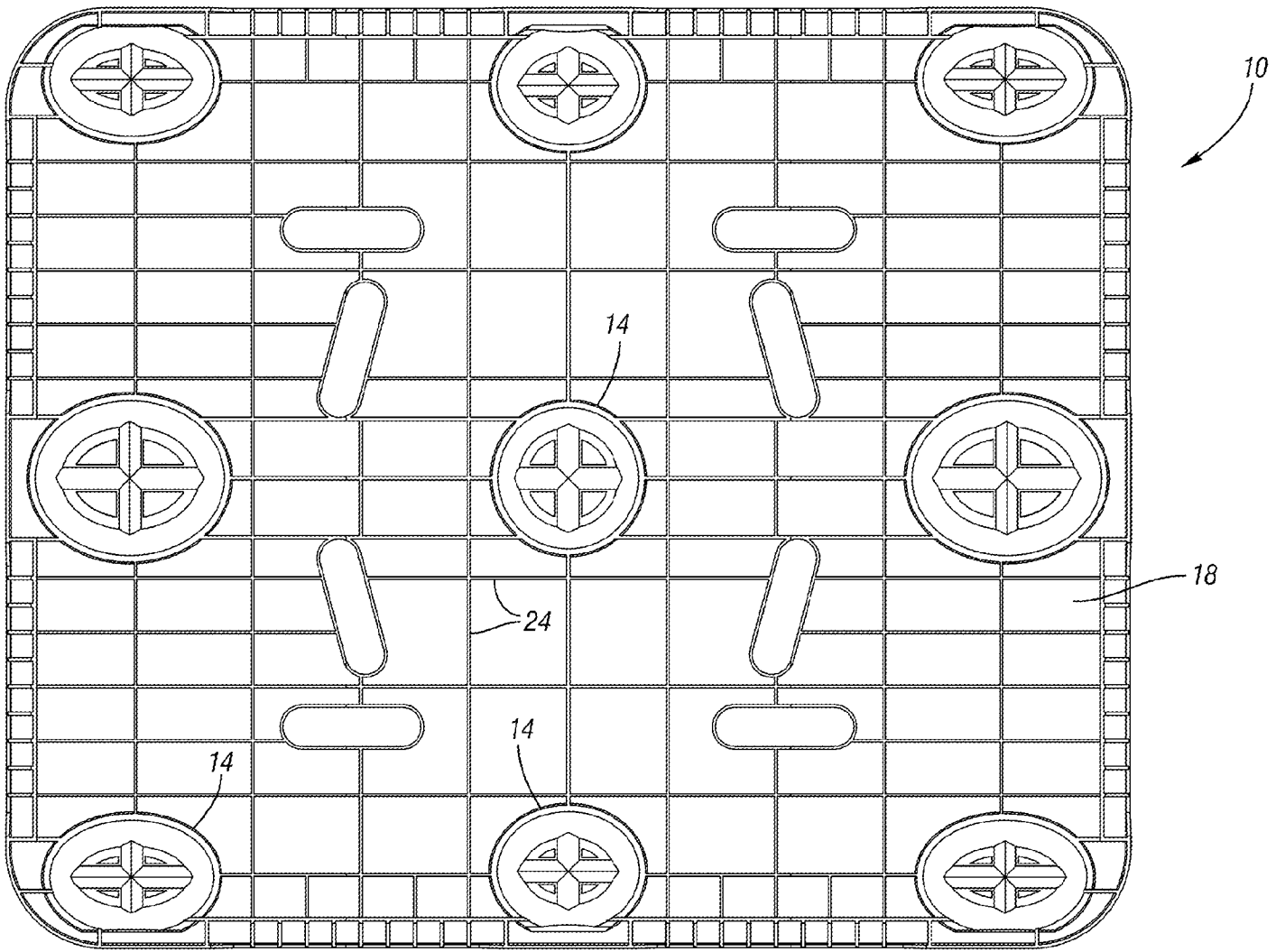
FIG. 3 is a bottom view of the pallet of FIG. 1.

Referring to FIG. 2, the upper deck 12 includes an upper planar member 18 from which extend a plurality of cross-ribs 24. The ribs extend in an intersecting pattern on the bottom of the deck 12. A peripheral rib 26 extends about the periphery of the container 10. Outside the peripheral rib 26, a plurality of tapered ribs 28 form a champfer, thus facilitating lifting the pallet 10 with a forklift. FIG. 3 is a bottom view of the pallet of FIG. 2.

Figure 4:
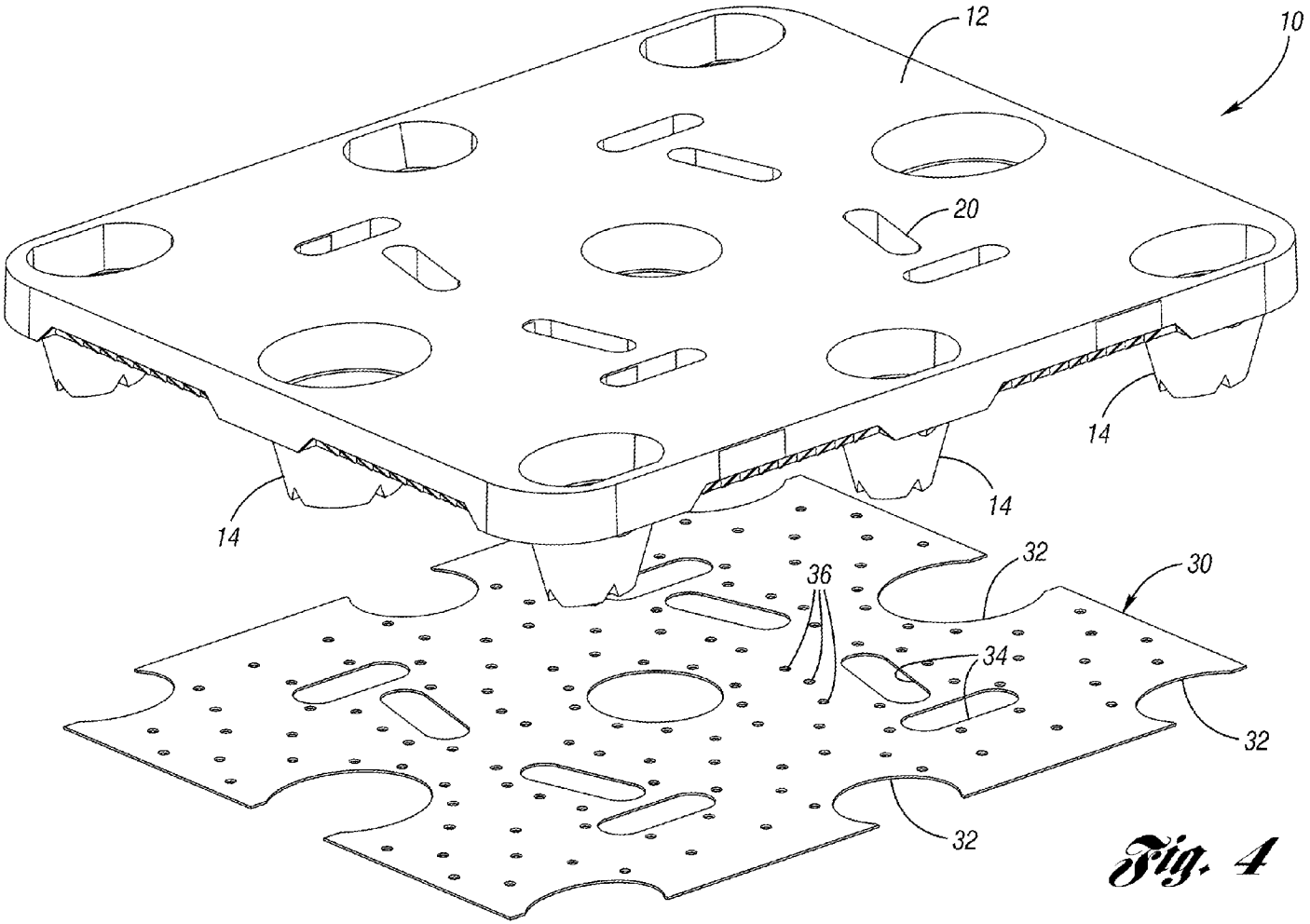
FIG. 4 is an exploded view of the pallet of FIG. 1 with an optional reinforcement sheet.

FIG. 4 is an exploded view of the pallet 10 with an optional reinforcement sheet 30. The reinforcement sheet 30 is an injection molded thermoplastic, but other materials and other manufacturing techniques could also be utilized. The sheet 30 includes a plurality of openings 32, each corresponding to one of the feet 14. The sheet 30 further includes a plurality of openings 34 aligning with the handles 20 of the upper deck 12. The sheet 30 further includes a plurality of small apertures 36 for drainage.

When increased strength and stiffness of the pallet 10 is desirable, the sheet 30 is vibration welded to the ribs 24 (FIG. 2) of the upper deck 12.

Figure 5:
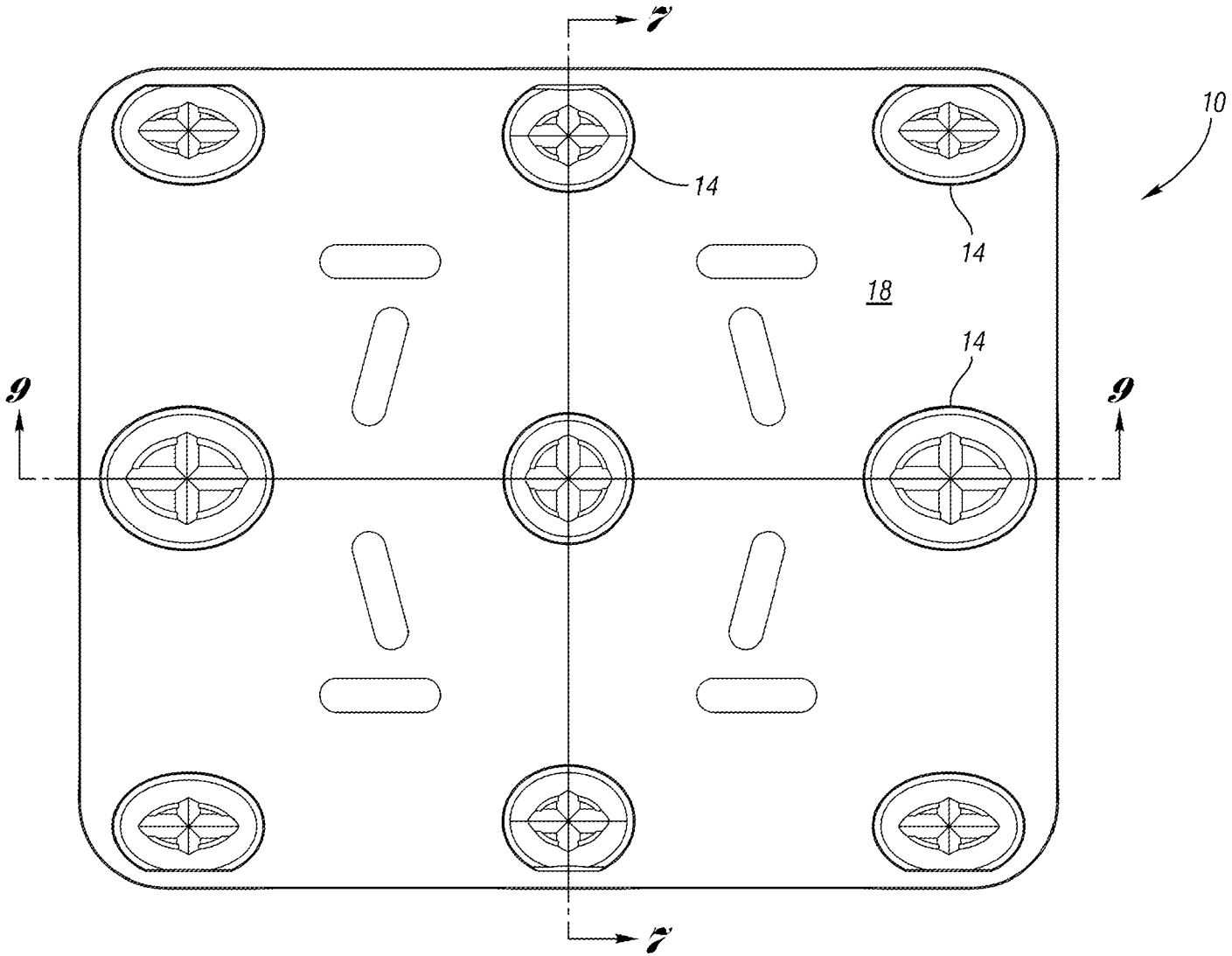
FIG. 5 is a top view of the pallet and reinforcement sheet of FIG. 4.
Figure 6:
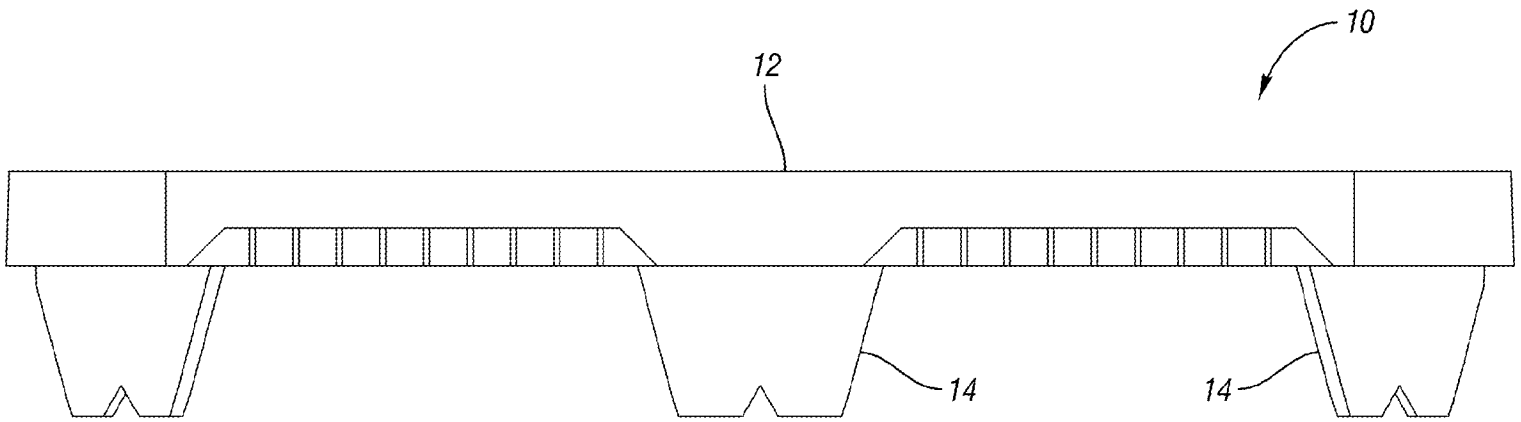
FIG. 6 is a side view of the pallet of FIG. 4.

FIG. 5 is a top view of the pallet 10 of FIG. 4. FIG. 6 is a side view of the pallet 10.

Figure 7:
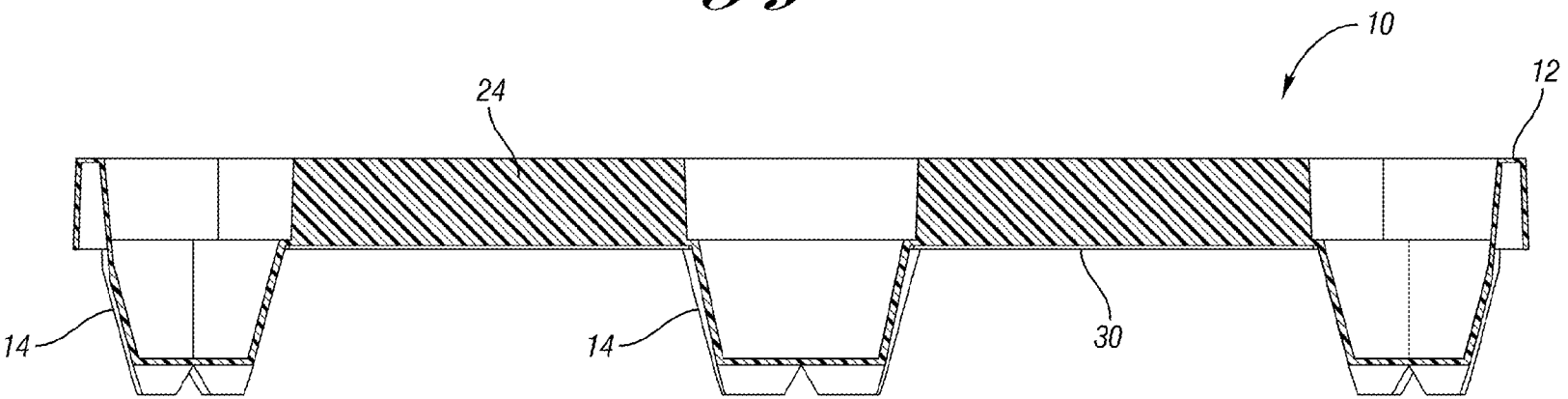
FIG. 7 is a section view taken along line 7-7 of FIG. 5.

FIG. 7 is a section view taken along line 7-7 of FIG. 5. As shown, the reinforcement sheet 30 is secured to the ribs 24 of the upper deck 12. This creates box beam sections in the upper deck 12. This significantly increases the strength and stiffness of the upper deck 12.

Figure 8:
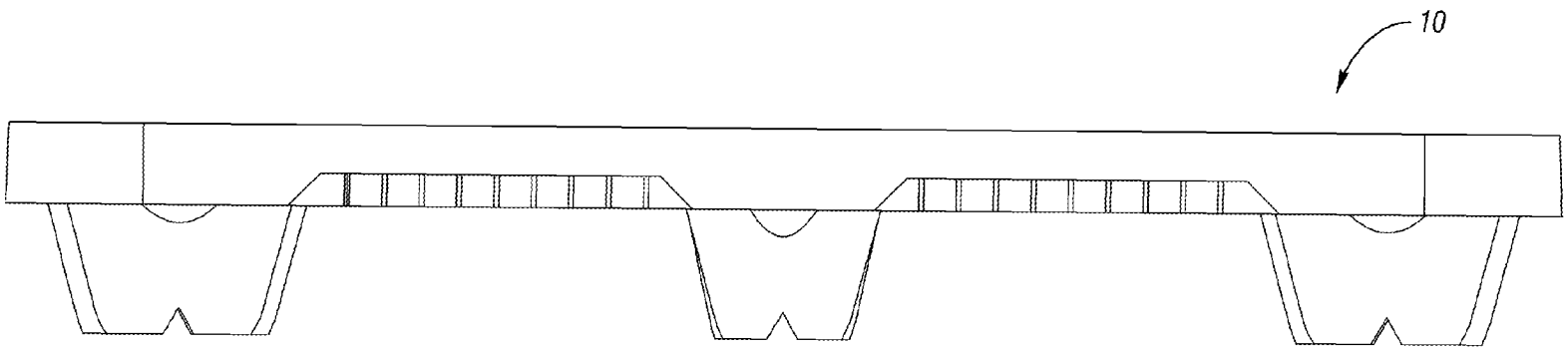
FIG. 8 is an end view of the pallet of FIG. 4.
Figure 9:
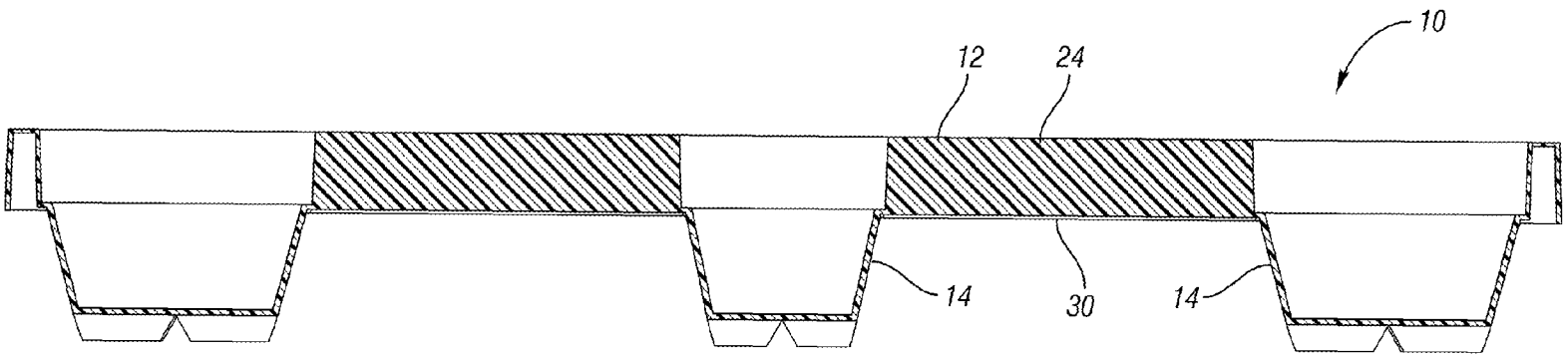
FIG. 9 is a section view taken along line 9-9 of FIG. 5.

FIG. 8 is a front view of the pallet 10. FIG. 9 is a section view of the pallet 10 and reinforcement sheet 30 taken along line 9-9 of FIG. 5. The reinforcement sheet 30 is vibration welded to the ribs 24, which extend perpendicular to one another in the upper deck 12. This creates the box beam sections.

Figure 10:
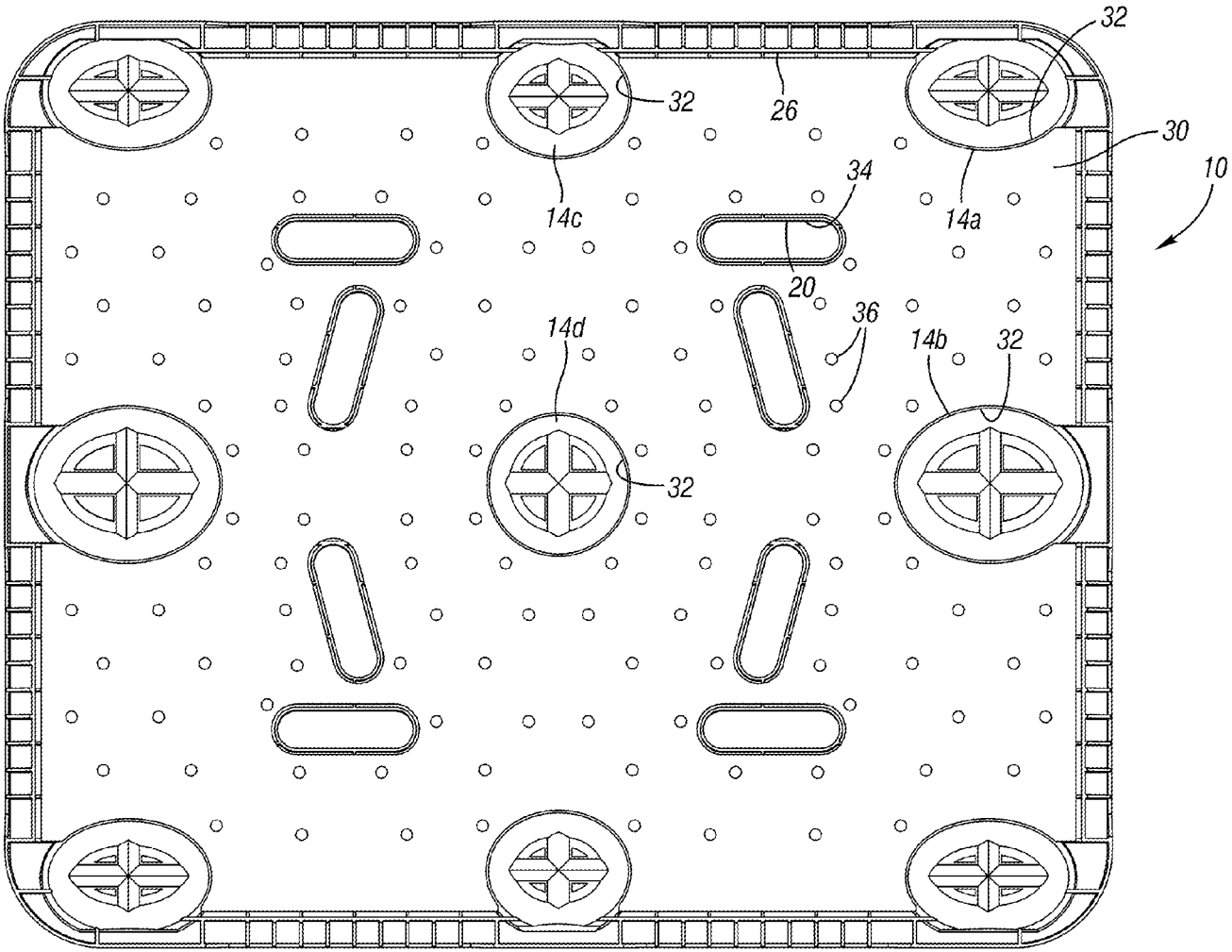
FIG. 10 is a bottom view of the assembled pallet of FIG. 4.

FIG. 10 is a bottom view of the pallet 10 with the reinforcement sheet 30 secured thereto. The feet 14 are received within the openings 32 in the sheet 30. The center foot 14 is completely circumscribed by the center opening 32, while the side feet 14*c* are partially circumscribed (more than 180 degrees, but less than 360 degrees), and the corner feet 14*b* are circumscribed less than 180 degrees. Further, the openings 34 align with the handle openings 20. The apertures 36 provide drainage to the box beam sections, i.e. the cavities defined among the upper planar member 18 (FIG. 1,) the cross-ribs 24 (FIG. 2) and the reinforcement sheet 30 ("lower planar member").

The pallet 10 can thus be easily provided in two versions, one with the reinforcement sheet 30, or alternatively without the reinforcement sheet 30, to provide either a stronger, stiffer pallet 10 or a lighter pallet 10.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope. Alphanumeric identifiers for steps in method claims are for ease of reference in dependent claims and do not signify a required sequence unless otherwise stated.

What is claimed is:

1. A nestable pallet comprising:

a deck;

a plurality of feet extending downward from the deck, the plurality of feet including a center foot and a plurality of peripheral feet;

the deck including a planar member having a plurality of holes therethrough for receiving feet of a similar pallet, each of the holes aligned with one of the plurality of feet, the deck further including at least one handle hole;

the deck including a plurality of ribs extending downward from the planar member; and a reinforcement sheet having foot openings for receiving the feet and at least one handle opening for aligning with the at least one handle hole in the deck, the reinforcement sheet having a planar upper surface for mating with the plurality of ribs, the reinforcement sheet sized to be connected to the plurality of ribs of the deck, wherein the plurality of feet extend downwardly of the reinforcement sheet, such that lowermost surfaces of the plurality of feet are spaced downwardly from the reinforcement sheet, wherein the reinforcement sheet further includes a plurality of drainage holes, and the at least one handle hole of the deck and the at least one handle opening of the reinforcement sheet have a different shape than the plurality of drainage holes, the at least one handle opening of the reinforcement sheet is located outwardly of a center foot opening and is completely surrounded by the material of the reinforcement sheet.

2. The nestable pallet of claim 1 wherein the deck and the reinforcement sheet form a plurality of box beam sections.

3. The nestable pallet of claim 2 wherein the feet are integrally molded with the planar member.

4. The nestable pallet of claim 1 wherein at least one of the plurality of ribs extends between each adjacent pair of the plurality of feet.

5. The nestable pallet of claim 1 wherein the upper surface of the reinforcement sheet is connected to the plurality of ribs.

6. The nestable pallet of claim 5 wherein the reinforcement sheet is vibration welded to the plurality of ribs.

7. The nestable pallet of claim 5 wherein at least a first foot opening of the foot openings completely circumscribes at least a first foot of the plurality of feet.

8. The nestable pallet of claim 7 wherein the first foot opening is the center foot opening and the first foot is a center foot.

9. The nestable pallet of claim 8 wherein each of the plurality of foot openings other than the first foot opening less than completely circumscribes its associated foot.

10. A nestable pallet comprising:

a deck having a planar member;

a plurality of hollow feet integrally molded with the planar member, the plurality of hollow feet including a center foot and a plurality of peripheral feet;

the planar member having a plurality of holes therethrough for receiving feet of a similar pallet, each of the holes aligned with one of the plurality of feet, the deck further including at least one handle hole;

the deck including a plurality of ribs extending downward from the planar member; and a planar reinforcement sheet having openings for receiving the feet and at least one handle opening for aligning with the at least one handle hole in the deck, a planar upper surface of the reinforcement sheet connected to the plurality of ribs of the deck, wherein at least a first opening of the openings completely circumscribes at least a first foot of the plurality of feet, wherein the reinforcement sheet circumscribes each of the plurality of feet more than 180 degrees, such that a portion of the reinforcement sheet is between an immediately adjacent periphery of the pallet and each of the plurality of feet, wherein the plurality of feet extend downwardly of the reinforcement sheet, such that lowermost surfaces of the plurality of feet are spaced downwardly from the reinforcement sheet, wherein the reinforcement sheet further includes a plurality of drainage holes, and the at least one handle hole of the deck and the at least one handle opening of the reinforcement sheet have a different shape than the plurality of drainage holes, the at least one handle opening of the reinforcement sheet is located outwardly of a center foot opening and is completely surrounded by the material of the reinforcement sheet.

11. The nestable pallet of claim 10 wherein the deck and the reinforcement sheet form a plurality of box beam sections.

12. The nestable pallet of claim 10 wherein at least one of the plurality of ribs extends between each adjacent pair of the plurality of feet.

13. The nestable pallet of claim 10 wherein the reinforcement sheet is vibration welded to the plurality of ribs.

14. A nestable pallet comprising:

a deck having a planar member and a plurality of cross-ribs extending downwardly therefrom;

a plurality of hollow feet integrally molded with the planar member, the plurality of feet including a center foot and a plurality of peripheral feet;

the planar member having a plurality of holes therethrough for receiving feet of a similar pallet, each of the holes aligned with one of the plurality of feet, the deck further including at least one handle hole; and a reinforcement sheet having at least one handle opening for aligning with the at least one handle hole in the deck, a planar upper surface and a planar lower surface, the planar upper surface of the reinforcement sheet secured directly to the plurality of cross-ribs of the deck, the reinforcement sheet having a center opening completely circumscribing a first foot of the plurality of feet and a plurality of peripheral openings each partially but not completely circumscribing the plurality of peripheral feet such that a portion of the reinforcement sheet is between a nearest periphery of the pallet and each of the plurality of feet, the plurality of feet extending downwardly of the reinforcement sheet, such that a lowermost surface of the plurality of feet is spaced downwardly from the reinforcement sheet, wherein the reinforcement sheet further includes a plurality of drainage holes, and the at least one handle hole of the deck and the at least one handle opening of the reinforcement sheet have a different shape than the plurality of drainage holes, the at least one handle opening of the reinforcement sheet is located outwardly of a center foot opening and is completely surrounded by the material of the reinforcement sheet.

15. The nestable pallet of claim 14 wherein the plurality of cross-ribs extending downwardly from the deck includes a plurality of tapered peripheral ribs extending downwardly from a periphery of the deck.

16. The nestable pallet of claim 15 wherein the reinforcement sheet does not cover the tapered peripheral ribs.

17. The nestable pallet of claim 1 wherein the at least one handle hole of the deck and the at least one handle opening of the reinforcement sheet are substantially oblong.

18. The nestable pallet of claim 1 wherein the plurality of foot openings of the reinforcement sheet are almost entirely curved.

19. The nestable pallet of claim 1 wherein the at least one handle opening of the reinforcement sheet is located inwardly of a remainder of the foot openings.

20. The nestable pallet of claim 10 wherein the plurality of foot openings of the reinforcement sheet are almost entirely curved.

21. The nestable pallet of claim 14 wherein the plurality of foot openings of the reinforcement sheet are almost entirely curved.

* * * * *